US009821197B2

(12) United States Patent
Bothwell

(10) Patent No.: US 9,821,197 B2
(45) **Date of Patent: *Nov. 21, 2017**

(54) SYSTEM AND METHOD FOR A GAME RACQUET INCLUDING A GROMMET ACTUATOR

(71) Applicant: Brett Bothwell, New York, NY (US)

(72) Inventor: Brett Bothwell, New York, NY (US)

( * ) Notice: Subject to any disclaimer, the term of this patent is extended or adjusted under 35 U.S.C. 154(b) by 3 days.

This patent is subject to a terminal disclaimer.

(21) Appl. No.: 15/077,077

(22) Filed: Mar. 22, 2016

(65) Prior Publication Data

US 2016/0199702 A1 Jul. 14, 2016

Related U.S. Application Data

(63) Continuation-in-part of application No. 14/304,981, filed on Jun. 15, 2014, now Pat. No. 9,320,946, which
(Continued)

(51) Int. Cl.
*A63B 49/02* (2015.01)
*A63B 51/00* (2015.01)
(Continued)

(52) U.S. Cl.
CPC ..... *A63B 49/02* (2013.01); *A63B 24/00* (2013.01); *A63B 24/0003* (2013.01);
(Continued)

(58) Field of Classification Search
CPC ..... A63B 49/00; A63B 49/002; A63B 49/02; A63B 49/027; A63B 49/022;
(Continued)

(56) References Cited

U.S. PATENT DOCUMENTS 1,558,507 A 10/1925 Rydee et al.
2,034,444 A 3/1936 Smolik et al.
(Continued)

FOREIGN PATENT DOCUMENTS

DE 2225595 12/1973
DE 2611970 9/1977
(Continued)

*Primary Examiner* — Raleigh W Chiu
(74) *Attorney, Agent, or Firm* — Lisa Foundation Patent Law Clinic at Arizona State University

(57) ABSTRACT

The present invention provides a game racquet including an integrated circuit capable of supporting a low-voltage energy current. An embodiment of the invention provides a game racquet including one or more enhancements attached or integrated on the racquet frame. These enhancements may include but are not limited to: one or more LEDs, a sound amplification device, and an electromagnetic vibration emitter. In a further embodiment, the game racquet responds electronically to ball impact on at least one of the strings, and subsequently performs and action or actions including but not limited to making a sound or sounds, triggering lights, triggering LEDs, triggering another type of automation on the racquet such as a vibration emitter within the handle. The game racquet frame comprising at least one string channel in the frame head, bridge, or other area, which houses an actuator responds mechanically to a string movement triggering electronic connection.

18 Claims, 12 Drawing Sheets

Related U.S. Application Data is a continuation-in-part of application No. 13/243,346, filed on Sep. 23, 2011, now Pat. No. 9,132,321, which is a continuation-in-part of application No. 13/046,723, filed on Mar. 12, 2011, now abandoned, and a continuation-in-part of application No. 12/072,030, filed on Feb. 21, 2008, now Pat. No. 7,938,747.

(51) Int. Cl.

| | |
|---|---|
| ***A63B 51/12*** | (2006.01) |
| ***A63B 71/06*** | (2006.01) |
| ***A63B 24/00*** | (2006.01) |
| ***A63B 49/11*** | (2015.01) |
| ***A63B 49/022*** | (2015.01) |
| ***A63B 49/028*** | (2015.01) |
| *A63B 49/14* | (2015.01) |
| *A63B 60/42* | (2015.01) |

(52) U.S. Cl.

CPC ..... *A63B 49/022* (2015.10); *A63B 49/028* (2015.10); *A63B 49/11* (2015.10); *A63B 51/00* (2013.01); *A63B 71/0622* (2013.01); *A63B 49/14* (2013.01); *A63B 51/12* (2013.01); *A63B 60/42* (2015.10); *A63B 2071/0625* (2013.01); *A63B 2071/0655* (2013.01); *A63B 2207/02* (2013.01); *A63B 2209/00* (2013.01); *A63B 2209/02* (2013.01); *A63B 2209/023* (2013.01); *A63B 2209/08* (2013.01); *A63B 2220/56* (2013.01)

(58) Field of Classification Search

CPC ..... A63B 49/028; A63B 49/14; A63B 51/00; A63B 51/12; A63B 71/0622; A63B 24/00; A63B 24/0003; A63B 2209/00; A63B 2209/023; A63B 2209/08; A63B 2071/0625; A63B 2071/0655; A63B 2207/02; A63B 2209/02; A63B 2220/56; A63B 60/42

See application file for complete search history.

(56) References Cited

U.S. PATENT DOCUMENTS

| | | | | |
|---|---|---|---|---|
| 3,874,667 | A | 4/1975 | Gallagher et al. | |
| 3,884,467 | A | 5/1975 | Sommer et al. | |
| 3,904,202 | A | 9/1975 | Delorean et al. | |
| 3,999,756 | A | 12/1976 | Head | |
| 4,005,862 | A | 2/1977 | Portz et al. | |
| 4,076,239 | A | 2/1978 | Hall | |
| 4,090,707 | A | 5/1978 | Saar | |
| 4,101,132 | A | 7/1978 | Conrey et al. | |
| 4,103,546 | A | 8/1978 | Hickey et al. | |
| 4,165,071 | A | 8/1979 | Frolow | |
| 4,206,917 | A | 6/1980 | Guillem et al. | |
| 4,441,712 | A | 4/1984 | Guthke | |
| 4,512,576 | A | 4/1985 | Dahlgren | |
| 4,566,695 | A | 1/1986 | Melby | |
| 4,613,138 | A | 9/1986 | Haythornthwaite | |
| 4,681,319 | A | 7/1987 | Zilinskas | |
| 4,765,620 | A | 8/1988 | Janes | |
| 4,772,021 | A | 9/1988 | Maynard | |
| 4,786,055 | A | 11/1988 | Darling | |
| 4,852,875 | A | 8/1989 | McLennan et al. | |
| 4,909,511 | A | 3/1990 | Deville et al. | |
| 4,983,242 | A | 1/1991 | Reed | |
| 4,995,608 | A | 2/1991 | von Hackewitz | |
| 5,029,859 | A | 7/1991 | Davis | |
| 5,054,779 | A | 10/1991 | Marrello | |
| 5,083,776 | A | 1/1992 | Liu | |
| 5,102,132 | A | 4/1992 | Chen | |
| 5,137,769 | A | 8/1992 | Landi | |
| 5,141,228 | A | 8/1992 | Soong | |
| 5,165,687 | A | 11/1992 | Soong | |
| 5,197,732 | A | 3/1993 | Lanctot | |
| 5,251,895 | A | 10/1993 | Darling | |
| 5,332,213 | A | 7/1994 | Klose | |
| 5,368,297 | A | 11/1994 | Liu | |
| 5,409,213 | A * | 4/1995 | Yeh | A63B 49/00 473/527 |
| 5,419,963 | A | 5/1995 | Kuebler | |
| 5,458,331 | A | 10/1995 | Bothwell | |
| 5,538,243 | A | 7/1996 | Yamamoto et al. | |
| 5,613,916 | A | 3/1997 | Sommer | |
| 5,762,570 | A | 6/1998 | Shaw | |
| 5,944,625 | A | 8/1999 | Janes | |
| 6,071,203 | A | 6/2000 | Janes et al. | |
| 6,270,434 | B1 * | 8/2001 | Shaw | A63B 49/08 473/461 |
| 6,409,616 | B1 * | 6/2002 | Lin | A63B 69/38 473/463 |
| 6,485,380 | B2 * | 11/2002 | Spangler | A63B 60/54 310/317 |
| 6,503,161 | B2 | 1/2003 | Bothwell | |
| 6,506,134 | B2 | 1/2003 | Bertolotti | |
| 6,530,851 | B2 | 3/2003 | Munster | |
| 6,800,239 | B2 | 10/2004 | Davis | |
| 6,971,964 | B1 * | 12/2005 | Bothwell | A63B 51/10 473/521 |
| 7,104,905 | B2 | 9/2006 | Schwenger et al. | |
| 7,326,133 | B1 * | 2/2008 | Choi | A63B 24/0021 473/553 |
| 7,396,303 | B2 | 7/2008 | Gazzara et al. | |
| 2004/0077438 | A1 * | 4/2004 | Choi | A63B 49/00 473/553 |
| 2004/0132562 | A1 * | 7/2004 | Schwenger | A63B 60/54 473/546 |
| 2004/0220001 | A1 | 11/2004 | Oister et al. | |
| 2005/0170919 | A1 * | 8/2005 | Schwenger | A63B 49/02 473/516 |
| 2005/0192129 | A1 * | 9/2005 | Kuwabara | A63B 43/06 473/520 |
| 2007/0105664 | A1 * | 5/2007 | Scheinert | A63B 49/00 473/461 |
| 2007/0105666 | A1 * | 5/2007 | Fernandez | A63B 49/00 473/553 |
| 2008/0139347 | A1 * | 6/2008 | Liao | A63B 67/18 473/549 |
| 2011/0021280 | A1 * | 1/2011 | Boroda | A63B 24/0021 473/220 |
| 2011/0165975 | A1 * | 7/2011 | Bothwell | A63B 51/00 473/535 |
| 2011/0183787 | A1 * | 7/2011 | Schwenger | A63B 49/00 473/553 |
| 2013/0053190 | A1 * | 2/2013 | Mettler | G09B 19/0038 473/463 |
| 2014/0296006 | A1 * | 10/2014 | Bothwell | A63B 49/02 473/524 |
| 2015/0045153 | A1 * | 2/2015 | Thurman | A63B 69/38 473/553 |

FOREIGN PATENT DOCUMENTS

| | | |
|---|---|---|
| DE | 3740765 | 6/1989 |
| EP | 0803271 | 8/1999 |
| EP | 060170 | 2/2015 |
| FR | 2587227 | 3/1987 |
| FR | 1059989 | 9/2013 |
| WO | 9847574 | 10/1998 |

* cited by examiner

SYSTEM AND METHOD FOR A GAME RACQUET INCLUDING A GROMMET ACTUATOR

CROSS REFERENCE TO RELATED APPLICATIONS

This application is a Continuation-in-part of U.S. application Ser. No. 14/304,981 filed on Jun. 15, 2014 by Brett Bothwell, entitled "System and Method for a Game Racquet Including an Actuator," which is a Continuation-in-part of U.S. application Ser. No. 13/243,346, entitled "System and Method for an Inflation Bladder Composite Game Racket." The U.S. application Ser. No. 13/243,346 is also a Continuation-in-part of U.S. application Ser. No. 13/046,723 by Brett Bothwell filed on Mar. 12, 2011 entitled "System and Method for a Pre-Formed Reinforcement Member for an Opening in a Game Racket", and a Continuation-in-part of U.S. application Ser. No. 12/072,030 entitled "Game Racket Including a Pivot Element" filed on Feb. 28, 2008, which claims priority to U.S. application Ser. No. 11/986,828 entitled "Substantially Fluid Tight Game Racket Including a Spring Suspension Module" by Brett Bothwell filed on Nov. 26, 2007. The disclosures of this application are herein incorporated by reference in their entirety.

BACKGROUND OF THE INVENTION

Growing the game of tennis and growing the business of tennis can be accelerated by engaging children in the game at an early age. Tennis and other racquet sports are challenging skill games which, require quite a bit of practice to master. It can be difficult to keep children engaged in games that require great concentration and patience. This is also true of the majority of recreational players of all ages. The tennis industry must continue to develop new methods of engaging players early and keeping them for the long term to ensure continued economic viability.

In order to attract and keep more players, particularly children, various efforts are being made to simplify the game with small racquets, foam balls, small nets, and reduced size courts. While these efforts are steps in the right direction, there is an element of the programs that still requires refinement, the racquets. The racquets for children have seen improvements in recent years. Children's racquets now are small and lightweight, with small grips, but there is a need for something even more engaging and entertaining

FIELD OF THE INVENTION

Aspects of the present disclosure relate to the field of game racquet frames. In particular, this disclosure relates to game racquet frames comprising string channels with actuators integrated with a circuit and communicating with at least one string oscillation and used for striking any object such as but not limited, to a tennis ball, squash ball, racket-ball, or badminton bird. More specifically, the present invention relates to implementing actuators to complete a circuit and allow for sound, light, vibration, or any combination thereof to indicate when the strings are struck in a desired manner by the player.

DESCRIPTION OF RELATED ART

Game racquets typically comprise a head portion containing interwoven strings held in tension, a handle, and a shaft or throat connecting the head portion to the handle. Conventional composite racquets have holes spaced around the periphery of the head frame and bridge portions through which the strings are laced. Others have added lights or sounds to sports equipment, but not with the level of sophistication of the current invention. For example only and not by way of limitation, the present invention has the ability to differentiate between a desirable and undesirable location and force of impact.

One example of a manner in which lights have been added to racquets is U.S. Pat. No. 5,409,213 to Yeh (hereinafter "Yeh") which teaches an elastic concussion switch to give an amplified reverberatory sound and simultaneously cause a luminous body to illuminate whenever the ball is hit by the paddle. The racquet is either hit or not hit. No further distinctions are made.

Another example is U.S. Pat. No. 4,090,707 to Saar (hereinafter "Saar") which teaches a sounding device for attachment to the strings of a tennis racquet which provides a unique audible sound which indicates where on the tennis racquet the ball is struck by the racquet. Here an external device is attached to the strings in the region corresponding to the sweet spot. A ball striking the racquet in this area causes the device to produce a characteristic sound signaling the student and the instructor that the ball is making contact with the desirable area of the racket. As the point of impact moves further and further away from the sweet spot, the quality of the sound modifies in a characteristic manner, indicating to the trained ear the degree to which the player is failing to obtain the desired point of impact.

Moreover, U.S. Patent Application Number 2011/0183787 to Schwenger et al. (hereinafter Schewenger) teaches a sensor system that generates signal from the electrical sensor in response to the string force. The sensor systems may be attached together with other visual, audio, and tactile feedbacks systems in cooperation with the data collection system. However, this is distinguishable from the current racquet, because the signal in response to string tension to trigger the sensor is purely electrical, not a mechanical response.

Similarly, U.S. Pat. No. 4,076,239 to Hall (hereinafter "Hall"), U.S. Pat. No. 4,101,132 to Conrey et al. (hereinafter "Conrey"), and U.S. Pat. No. 4,852,875 to McLennan et al. (hereinafter "McLennan"), all teach external training devices that may be attached to a racquet as a teaching tool. These devices are attached directly to the strings of the racquet and provide an indication, usually audio, or audio-visual, when the racquet impacts the ball in the desired location. As such, they may interfere with the trajectory of the ball.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Pat. No. 5,409,213
U.S. Pat. No. 4,090,707
U.S. Pat. No. 4,076,239
U.S. Pat. No. 4,101,132
U.S. Pat. No. 4,852,875
U.S. Patent Application No. 2011/0183787

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicant(s)

will amend the specification to expressly recite the essential material that is incorporated by reference as allowed by the applicable rules.

BRIEF SUMMARY OF THE INVENTION

The present invention provides, among other things, both a racquet sports training device, and an engaging, entertaining device for children as well as adults. The present invention provides a game racquet with novel qualities for improving a player's skill level, and to engage and entertain players generally. While the invention is a youth-oriented design, adults may find the novel properties beneficial as well.

Implementations of a game racquet may comprise a circuit comprising an actuator that is configured to switch on and off the circuit in response to a change in a string oscillation, a power source coupled to the circuit, and a game racquet frame coupled to the circuit and the power source. The game racquet frame comprises a handle, a throat, a bridge member, and a head frame. The head frame may comprise a plurality of string channels configured to pass a string there through, wherein at least a channel among the plurality of string channels is further configured to house the actuator on a portion of a recessed channel on an outside facing surface and through the string channel.

Particular aspects may comprise one or more of the following features. The actuator may be tubular. The actuator may be in a shape of grommet. The actuator may be comprised of a metal alloy. The actuator may be comprised of a resilient material. The actuator may be comprised of injection molded plastic. The actuator may be comprised of reinforced composite plastic. The circuit may extend through the bridge member. The power source may comprise at least one of a battery and a solar cell. The frame may further comprise a plurality of string channels. The frame may further comprise a recessed channel on an outside facing surface connecting to the string channels and housing at least one of the circuits and the plurality of actuators casing the string. The actuator may further comprise an outer grommet with an inward conducting element and an inner grommet with an outward conducting element configured to form an electrical connection when the string movement is detected or the actuator is oscillated. The circuit may further comprise a plurality of lights configured to illuminate when the circuit is closed. The circuit may further comprise a vibration emitting device configured to vibrate when the circuit is closed. The circuit may further comprise a data collection device. The circuit may further comprise a sound amplification device.

Implementations of a game racquet may comprise a circuit comprising an actuator that is configured to switch on and off the circuit in response to a change in a string oscillation; and a game frame coupled to the circuit. The game racquet frame may comprise a handle, a throat, a bridge member, and a head frame. The head frame may comprise a plurality of string channels configured to pass a string there through, wherein at least a channel among the plurality of string channels is further configured to house the actuator on a portion of a recessed channel on an outside facing surface and through the string channel.

Particular aspects may comprise one or more of the following features. The circuit may further comprise a power source; and the power source may comprise at least one of a battery and a solar cell. The actuator may further comprise an outer grommet with an inward conducting element and an inner grommet with an outward conducting element configured to form a closed electrical connection when the string movement is detected or the actuator is oscillated in response to the string movement. The circuit may further comprise a plurality of lights configured to illuminate when the circuit is closed. The circuit may further comprise a data collection device. The circuit may further comprise a sound amplification device.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly set forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of pre-AIA 35 U.S.C. §112, ¶ 6 and post-AIA 35 U.S.C. §112(f). Thus, the use of the words "function," "means" or "step" in the Detailed Description or Description of the Drawings or claims is not intended to somehow indicate a desire to invoke the special provisions of pre-AIA 35 U.S.C. §112, ¶ 6 or post-AIA 35 U.S.C. §112(f), to define the invention. To the contrary, if the provisions of pre-AIA 35 U.S.C. §112, ¶ 6 or post-AIA 35 U.S.C. §112(f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of pre-AIA 35 U.S.C. §112, ¶ 6 or post-AIA 35 U.S.C. §112(f). Moreover, even if the provisions of pre-AIA 35 U.S.C. §112, ¶ 6 or post-AIA 35 U.S.C. §112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

FIG. 19 depicts a cross-sectional view of an actuator with string there through.

Figure 1:
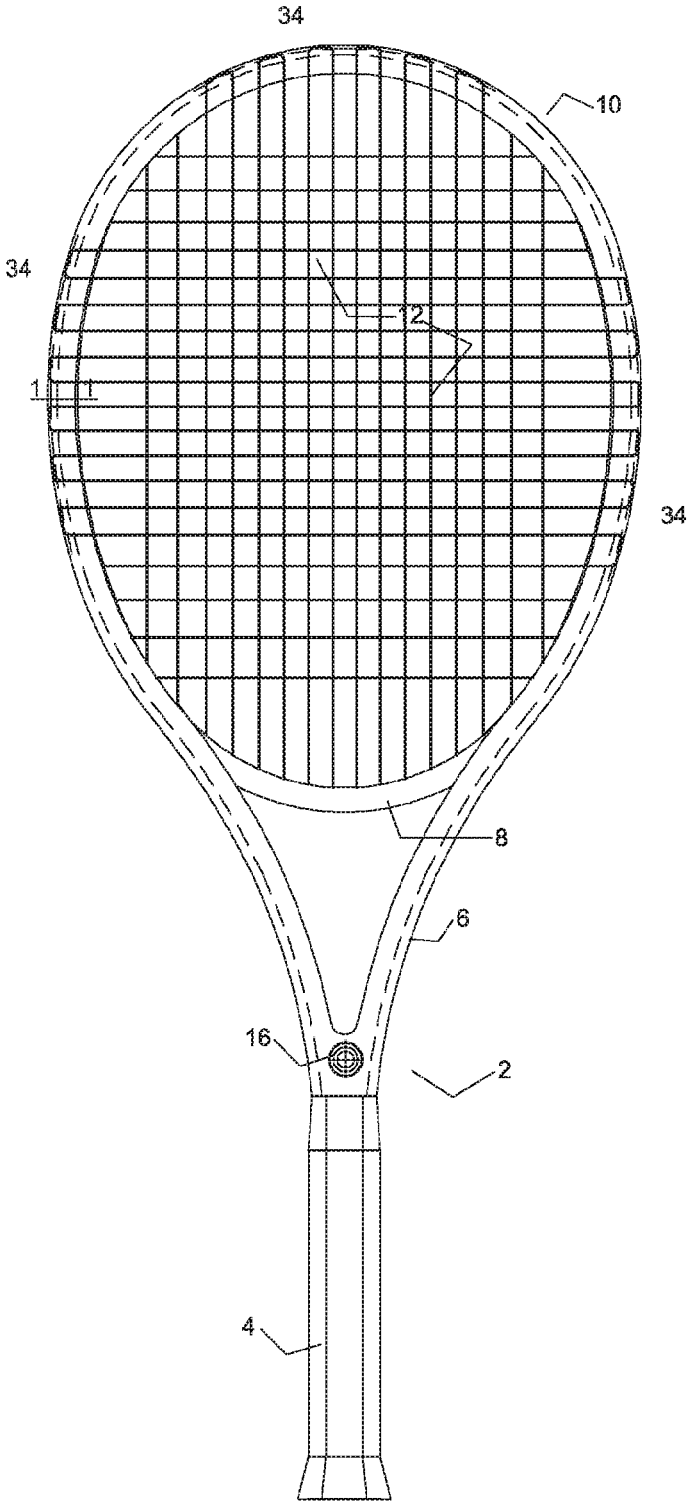
FIG. 1 depicts a front view of one embodiment of a game racquet.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Implementations of the present invention comprise a game racquet which utilizes an actuator or grommet plate housed on an outside facing surface of a head frame and passing through a string channel on such head frame, and cooperates with a string to initiate various forms of automation on the racquet. In the following discussion the term actuator may be understood to mean actuator or grommet plate interchangeably, as would be understood by one having ordinary skill in the art. By cooperating with a string, the actuator functions like a switch which is activated by a detection in string movement when, for example, a ball impacts a string. In one embodiment of the present invention, the actuator can be used as a switch to activate lights, to activate a sound amplification device, or it may be used to trigger other kinds of automation which may depend on the switching on and off of a current, such as for example, a low voltage current. In another contemplated embodiment, the actuator could also be employed in such a way as to collect information about the performance of the player using the racquet, and also about the performance of the racquet itself. By targeting specific areas of the stringed hitting surface with one or more actuators, an electronic record could be made of ball impacts in those critical string zones.

In another embodiment, the actuator of the invention may be implemented to activate one or more pressure sensors and provide generalized or very specific information regarding ball impact. By quantifying the pressure exerted by a string on the frame, such as for example, by using an actuator that informs a sensor, very specific information including but not limited to ball impact force and dwell time can be obtained.

One embodiment of the present invention provides a game racquet including a circuit capable of supporting a low-voltage energy current. Another embodiment of the invention provides a game racquet including one or more enhancements attached or integrated on the racquet frame. These enhancements may include but are not limited to: one or more light-emitting diodes (LEDs), a sound amplification device, an electromagnetic vibration emitter, and other such enhancements as would be apparent to one of ordinary skill in the art. In a further embodiment, the game racquet responds electronically to ball impact on at least one of the strings, and subsequently performs an action or actions including but not limited to making a sound or sounds, triggering one or more visual indicators such as one or more lights, triggering one or more LEDs, or triggering another type of automation on the racquet such as a vibration emitter within the handle. In still another embodiment, the racquet has the capacity to store energy, such as using a removable battery type, or other type of energy storage cell, to maintain power within a circuit. A variant of the invention may include one or more solar collecting panels on the racquet itself to collect and store energy. In one embodiment, a grommet plate of the present invention may be employed to trigger a response including but not limited to vibration, sound, and light, within the frame or the handle.

FIG. 1 shows a game racquet 2 including a handle 4, a throat 6, a bridge 8, and a head frame 10. The head frame 10 is woven with strings in a conventional way to form a string-bed 12. This schematic drawing shows the potential arrangement of the parts of the invention on a game racquet 2. For example only and not by way of limitation, a removable energy storage device 14, such as a battery, is shown within the handle. While other locations are contemplated in variants of the present invention, in some implementations, placing the removable energy storage device 14 within the handle may provide one or more advantages with regard to weight distribution and access. In this particular embodiment, a sound amplifying device 16 is located at the top end of the handle 4. The sound device 16 could be in another location such as on the bridge member 8, or potentially on the head frame 10 or somewhere else as alternate embodiments. A circuit 18 is integrated on the racquet 2 with the energy storage device 14 such that the sound amplifying device 16 can be triggered by ball impact.

Figure 2:
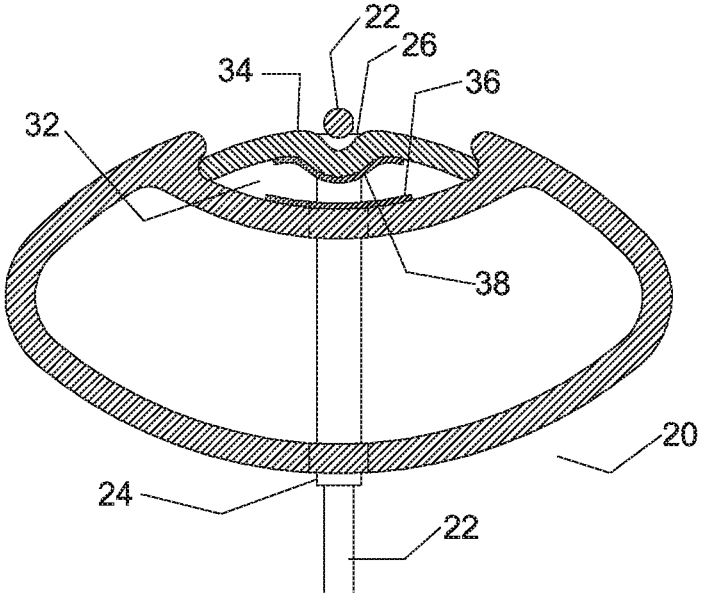
FIG. 2 depicts a cross-sectional view of the frame of a game racquet, along line 1-1 in FIG. 1.

FIG. 2 is a cross-sectional view, along line 1-1 in FIG. 1, of a head frame 10 or bridge member 8 of a game racquet 2 according to another embodiment of the present invention. As shown, actuator 34 acts as a switch that triggers circuit 18, and as depicted, the switch is in an off position so that the circuit is open. A string 22 is laced through a grommet 24 and a grommet strip 26, and through a string hole opening 28 in the frame profile 20 and through the actuator 34. The grommet 24 and grommet strip 26 are inserted in the hole opening 28 in a typical manner to protect the string 22 from a potentially sharp edge of the opening 28. On an outside facing surface 30 of the frame profile 20, a recess 32 is provided. An outer facing recess 32 is a common feature on modern racquets as a method of recessing and protecting a string 22 from damage on the outside edge.

The recess 32 in this embodiment may be used to house both the actuator 34 and a circuit 18. The actuator 34 can cooperate with a string 22 by bending and flexing up and down against the profile 20 as string tension increases and decreases. In a preferred embodiment, a portion of the circuit 18 is located on an outer facing exposed conducting surface 36 located on the bottom of the recess 32 and another portion of the circuit 18 is located on an inside facing surface 38 of the actuator 34. The actuator 34 shown in this embodiment may be made of a resilient material including but not limited to injection molded plastic or a reinforced composite plastic. In other embodiments, the actuator 34 could be made of a metal alloy or other suitable materials apparent to those skilled in the art. The relative strength of the material and the concave curvature of the actuator 34 profile is intended to support a string 22 under tension, yet allow the actuator 34 to compress further when the tension of the string 22 is increased, such as when a ball impacts the string-bed 12.

Figure 3:
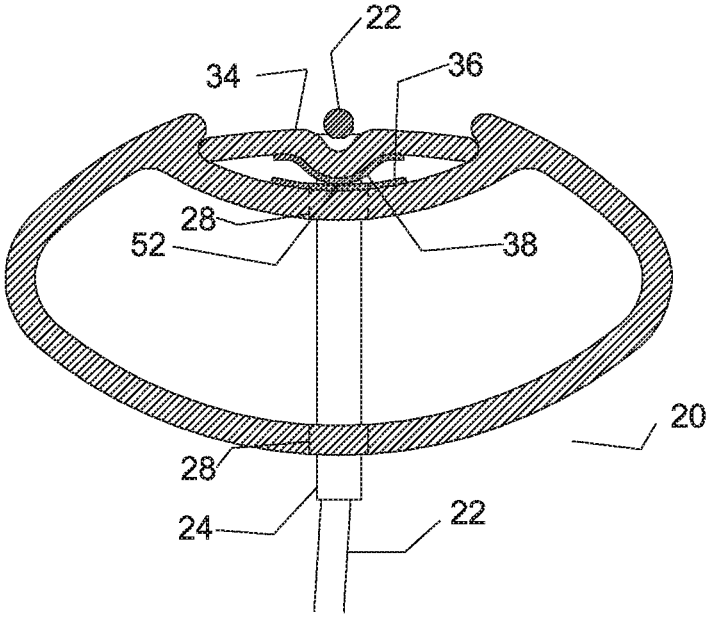
FIG. 3 depicts the same cross-sectional view of the frame of a game racquet, along line 1-1 in FIG. 1, with the string movement under ball impact.

FIG. 3 is a cross-sectional view of the head frame or bridge member, along line 1-1, as the tension of the string has been increased, for example due to a ball impacting the string-bed 12, and the switch is closed such that the circuit is on. Increased tension in the string 22 has compressed the resilient actuator 34 inward to touch its underside to the exposed conducting surface 36 in the bottom of the recess 32, therefore closing the circuit 18 like a switch and activating a flow of current through the circuit 18. In one embodiment, the flow of current in the circuit 18 therefore can be triggered by ball impact and can be employed to activate a sound amplification device 16, a light emitting device 40, a vibration emitting device 42, or another form of automation which can be generated by low voltage power from the circuit 18. In another embodiment, the current flow generated by the actuator 34 is used in conjunction with a data collecting device 44 to record information including but not limited to a number of successful hits, etc.

Figure 4:
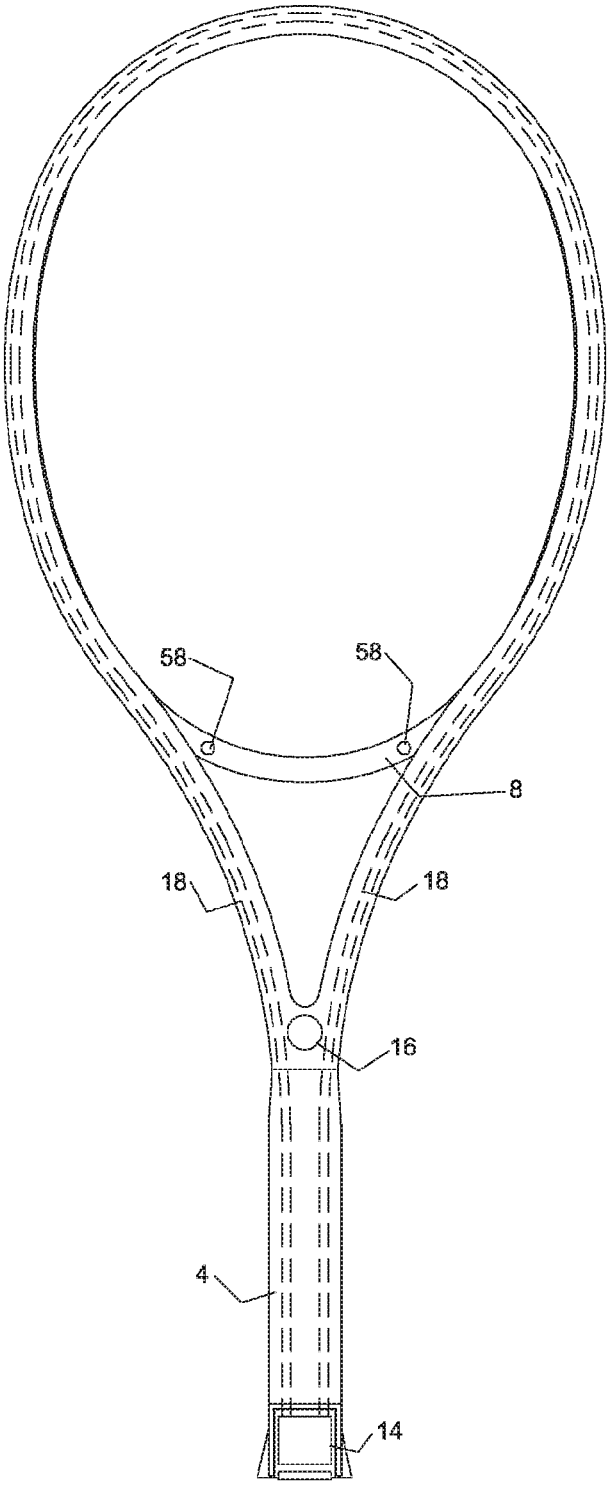
FIG. 4 depicts a front elevation view of the circuitry of a game racquet.

FIG. 4 is a front elevation view showing a preferred arrangement of parts of a circuit 18, of the game racquet 2 of the present invention. This schematic representation shows one embodiment depicting an arrangement of multiple elements of a circuit 18 to achieve an implementation of the invention. An energy storage device 14, for example, a battery, is located in the handle 4 end of the racquet 2. The handle 4 end of the racquet 2 is a logical location for the storage device 14 in mitigating the effects of its additional weight. The location also lends itself to easy access for replacement of the storage device 14. A removable end-cap is simple to install in this location. However, other locations are contemplated variations. The device 14 provides low voltage electrical current to a circuit 18 which is integrated with the racquet 2. The circuit 18 has an inside portion and an outside portion. Both portions of the circuit 18 are continuous around the head frame 10 and can be integrated with a bridge member 8 as well. At least one actuator 34 on the head frame 10 or bridge member 8, is integrated with the circuit 18 and cooperates with at least one string 22. The circuit 18 is completed and the flow of a current is triggered, when at least one actuator 34, cooperating with a string 22, is closed by an increase in string tension, for example by a ball impacting a string 22. In a preferred embodiment, a sound amplification device 16 is located at a top end of the handle 6. Other embodiments contemplate a device 16 located on the racquet 2 at any point along the circuit 18. In still further embodiments, a device 16 could be located inside the handle 6, or on the bridge member 8, or on the bottom end of the handle 6. As long as the device 16 can be connected to the circuit 18, its location will be further determined by available space on the racquet 2 and by the method of manufacture.

In an alternate embodiment, to further enhance the game racquet and to reduce the weight of its energy storage device 14, a solar collection device 58 can also be installed on the racquet as is shown in FIG. 4. The solar device 58 could easily be connected, utilizing the techniques described herein, to the energy storage device 14 and/or the circuit 18 to provide an alternate source of energy/current for the system of the invention.

A central issue in manufacturing the game racquet 2 of the present invention is determining how to integrate the circuit 18 and other elements of the new design using known methods of game racquet manufacture. Of the few accepted racquet molding and fabrication methods, each one presents unique challenges for locating a conducting element 56 of a circuit 18 and any other of the system elements of the present invention. There are simple solutions for each represented here, and those skilled in the art will likely comprehend more.

One economical method of making game racquets utilizes aluminum in a process of extruding metal alloys and bending to shape, and it lends itself to making junior game racquets in particular due primarily to the smaller size. The extrusion process does not allow for the integration of a separate conducting element 56 within the racquet frame itself and therefore, in one embodiment, one or more conducting elements 56 of a circuit 18 on an extruded metal frame are installed separately. In this embodiment the conducting elements can be integrated with an injection molded plastic part such as a grommet strip 26. Required elements are integrated within the handle 4. The handle 4 is made of high-density foam on a metal racquet in a typical embodiment. An embodiment of this extruded metal alloy game racquet of the present invention is shown in FIGS. 5-11.

The composite inflation bladder molding method of making a high-performance game racquet allows the conducting elements for a circuit 18 to be integrated within the frame itself. An example of this technique can be seen in FIG. 15. Some conducting elements of a circuit 18 in a composite racquet may need to be integrated with other parts like for example, a grommet strip 26, but the ability to locate conducting elements within the composite material itself, makes composite manufacturing well suited for a game racquet of the present invention.

Other methods for integrating a circuit with a game racquet will become known to others with skill in the art. For example, a unique carbon composite material exists with piezo-electric capacity. Its ability to conduct electromagnetic energy could potentially eliminate the need for a separate conducting element 56 in the game racquet of the present invention altogether. The racquet frame itself is potentially a circuit and therefore the extra weight of separate parts, and complexities of fabrication could be eliminated.

Figure 5:
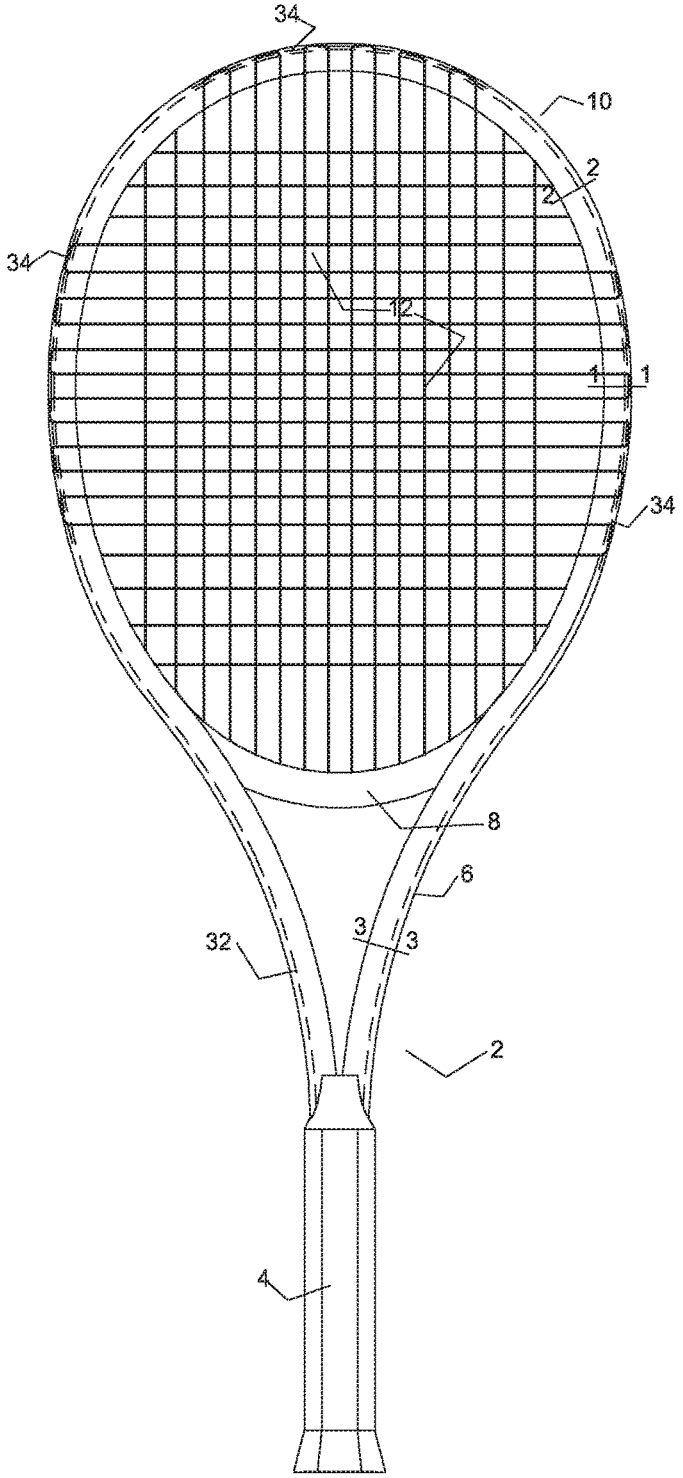
FIG. 5 depicts a front elevation view of a game racquet.

FIG. 5 is a front elevation view of a game racquet 2 of the invention. This embodiment is made using an extruded metal alloy. The extrusion makes for a continuous outside facing recess 32 on the frame profile 20. A typical metal alloy game racquet 2 can have a bridge member made separately, often of a different material such as plastic, and it could lend itself to integration of a conducting element 56 and/or a light emitting device 40. In this particular embodiment at least one actuator 34 is located at 3, 9, and 12 o'clock on the head frame 10.

Figure 6:
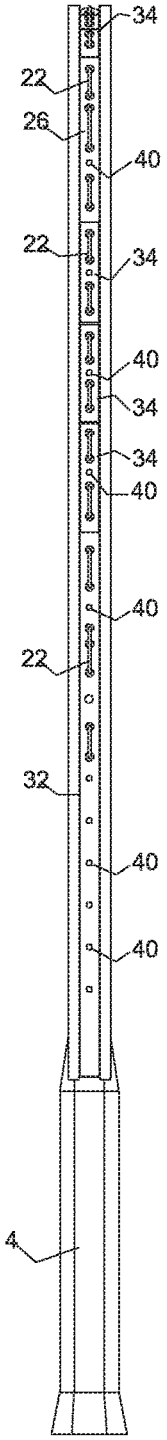
FIG. 6 depicts a side elevation view of a game racquet.

FIG. 6 shows a side elevation view of the game racquet of FIG. 5. An outside facing recess 32 is seen continuous from the top of the handle 4 up and around the top of the racquet 2. A grommet strip 26 is located in the recess 32 around the periphery of the head frame 10. The strip 26, without grommets, becomes a LED 40 strip and continues along the throat 6, to the top of the handle 4.

Figure 7:
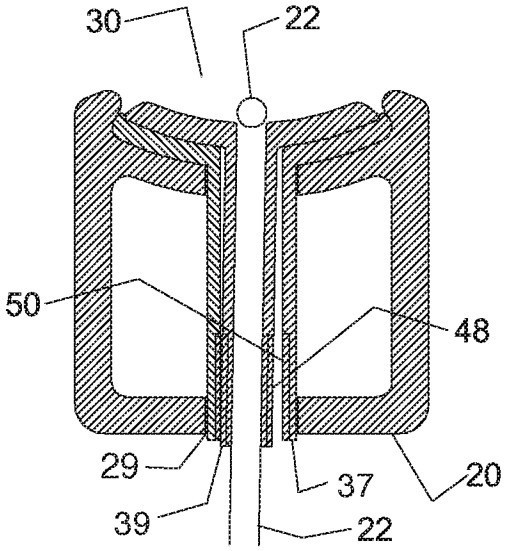
FIG. 7 depicts a cross-sectional profile view of the frame of a game racquet, along line 1-1 in FIG. 5.

FIG. 7 shows a cross-sectional profile view, along line 1-1 in FIG. 5, of a head frame 10 or bridge member 8 profile of an embodiment of the current invention. This particular profile 20 is well suited for extrusion in metal alloy or another similar material, making it cost effective and a good fit for a junior game racquet 2. A string 22 is laced through a grommet 24 with an outer grommet 37 and inner grommet 39, and through a string channel 29 in the profile 20. The outer grommet 37 has an inward conducting element 50 which forms the inside portion of the circuit 18. Another portion of the circuit 18 is located on an outward conducting element 48 of the inner grommet 39. A simple working example of an exposed conducting surface 36 could be achieved with an adhesive backed copper coated foam tape.

The recess 32 in this embodiment may be used to support housing of a portion of an actuator 34 and a circuit 18. The actuator 34 can cooperate with a string 22 by oscillating inside the string channel 29 against the profile 20 as string oscillates in response to ball impact. In a preferred embodiment, a portion of the circuit 18 is located inside the string channel 29 on the inward conducting element 50 of an outer grommet 37 located on the outer circumference of string channel 29 connected to the profile 20; and another portion of the circuit 18 is located on the outward conducting element 48 of an inner grommet 39 of the actuator 34. The actuator 34 shown in this embodiment may be made of a resilient material including but not limited to injection molded plastic or a reinforced composite plastic. In other embodiments, the actuator 34 could be made of a metal alloy or other suitable materials apparent to those skilled in the art. The relative strength of the material and is intended to support a string 22 with oscillation, yet allow the actuator 34 to oscillate when the movement of the string 22 is detected, such as when a ball impacts the string-bed 12.

Figure 8:
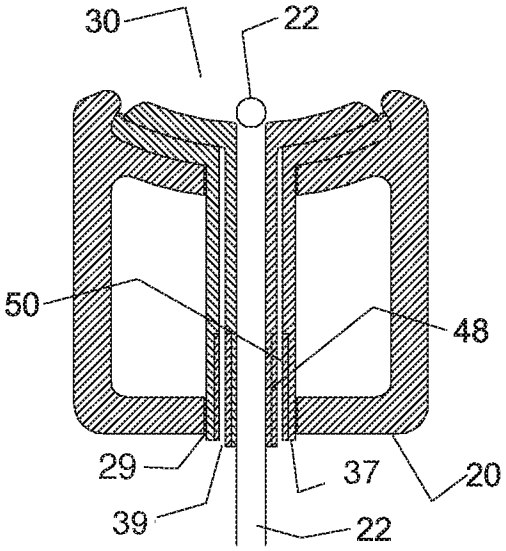
FIG. 8 depicts a cross-sectional profile view of the frame of a game racquet, along line 1-1 in FIG. 5, with the string movement under ball impact.

FIG. 8 shows a cross-sectional profile view, along line 1-1 in FIG. 5, of a head frame 10 or bridge member 8 profile of the present invention. This profile view shows the actuator 34 in the closed position, after a string movement has been detected, for example due to a ball impacting a string 22. A cross-sectional view of the head frame or bridge member, along line 1-1, as the movement of the string has been detected, for example due to a ball impacting the string-bed 12, and the switch is closed such that the circuit is on. The string movement in the string 22 has oscillated the resilient actuator 34 inside the string channel 29 to touch its outward conducting element 48 of the inner grommet 39 to the outer grommet 37's inward conducting element 50 housed at the outer circumference of string channel 29 connected to the profile 20, therefore closing the circuit 18 like a switch and activating a flow of current through the circuit 18.

In one embodiment, the flow of current in the circuit 18 therefore can be triggered by ball impact and can be employed to activate a sound amplification device 16, a light emitting device 40, a vibration emitting device 42, or another form of automation which can be generated by low voltage power from the circuit 18. In another embodiment, the current flow generated by the actuator 34 is used in conjunction with a data collecting device 44 to record information including but not limited to a number of successful hits, etc.

Figure 9:
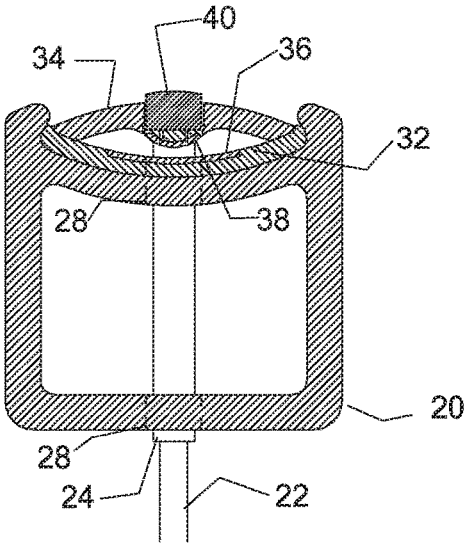
FIG. 9 depicts a cross-sectional profile view of the frame of a game racquet, along line 2-2 in FIG. 5.

FIG. 9 shows a cross-sectional profile view, along line 2-2 in FIG. 5, of a frame profile 20 on the head frame 10. This particular view shows how a light emitting device 40 can be located on an actuator 34. Beyond the line of the cross-section a string 22 can be seen laced through a grommet 24 and a grommet strip 26, and through a hole opening 28 in the frame profile 20, and also through a hole opening 28 in the actuator 34.

Figure 10:
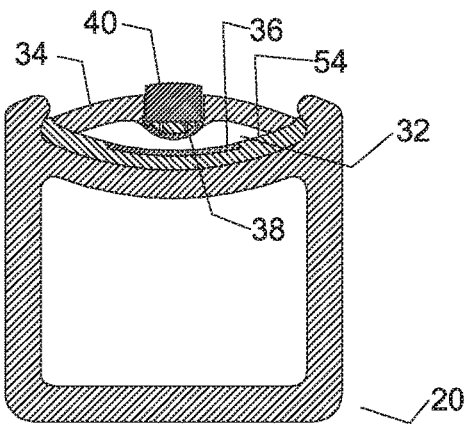
FIG. 10 depicts a cross-sectional profile view of the frame of a game racquet, along line 3-3 in FIG. 5.

FIG. 10 shows a cross-sectional profile view, along line 3-3 in FIG. 5, of the throat 6 of the game racquet of the present invention. This profile 20 shows an actuator 34 which is essentially inactive in the throat 6 area due to the lack of a string 22. A conducting element 56 is located in the actuator 34 and in a conductor strip 54 which are continuous along the throat 6 to the handle 4 in the recess 32.

Figure 11:
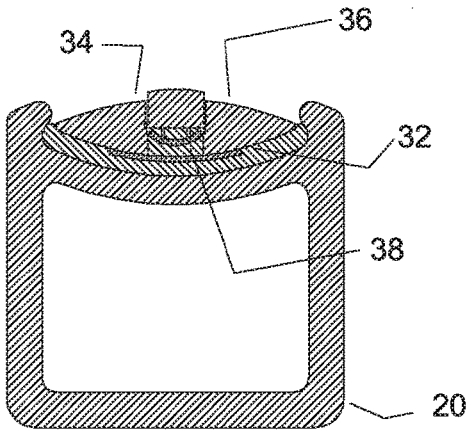
FIG. 11 depicts a cross-sectional profile view of the frame of a game racquet, along line 3-3 in FIG. 5.

FIG. 11 shows a cross-sectional profile view, along line 3-3 in FIG. 5, of the game racquet of the invention. This is an alternate profile 20 which shows a stationary actuator like part in place of the actuator 34. Of course on the throat 6 portion, there are no strings, so a dynamic actuator 34 is not necessary. As in FIG. 10, the actuator 34 can be continued to the handle 6 for simplicity, but it is inactive, and in this case it is merely a way to contain and continue a conducting element to the handle 6 portion of the racquet 2.

The actuator 34 of the invention can exist in a number of forms. The actuator 34 must be made of a material that is sufficiently resilient, yet strong enough to carry a string 22 tension load and still retain some ductile capacity. In a junior game racquet 2 that is typically smaller, lighter, strung at a much lower tension than a high performance adult racquet 2, the actuator 34 can be made of a lower strength/capacity material such as injection molded plastic. If the actuator 34 is made of lower strength injection molded plastic for example, it may be advantageous to integrate it with the grommet 24 and grommet strip 26 which are typically made by injection molding. A grommet strip 26 for example could be enlarged and formed with a concave bottom, making it a low capacity actuator 34.

The actuator 34 of a high performance adult game racquet 2 must be much stronger in order to flex under much greater string 22 tension loads and therefore would likely be made of a reinforced composite plastic or a metal alloy or another suitably high strength lightweight material. If the actuator 34 is a high capacity version made from a high strength material, the grommet 24 and grommet strip 26 can be made separately and from another material such as injection molded plastic.

Maximum actuator 34 capacity for a full tension-loaded adult game racquet 2 can be achieved by making it in a tubular form such as that shown in FIGS. 9 and 10. This cross-sectional view along line 2-2 in FIG. 5, shows a tubular actuator/pressure plate 34 which is strong enough to support a full high performance string 22 tension load, and yet still have some resiliency left to compress under minimal tension increases, such as that of a ball impacting the string-bed 12. A tubular actuator 34 can be made from reinforced composite plastic, injection molded plastic, metal alloy, or another material with the appropriate strength, weight, and resiliency could be used.

Figure 12:
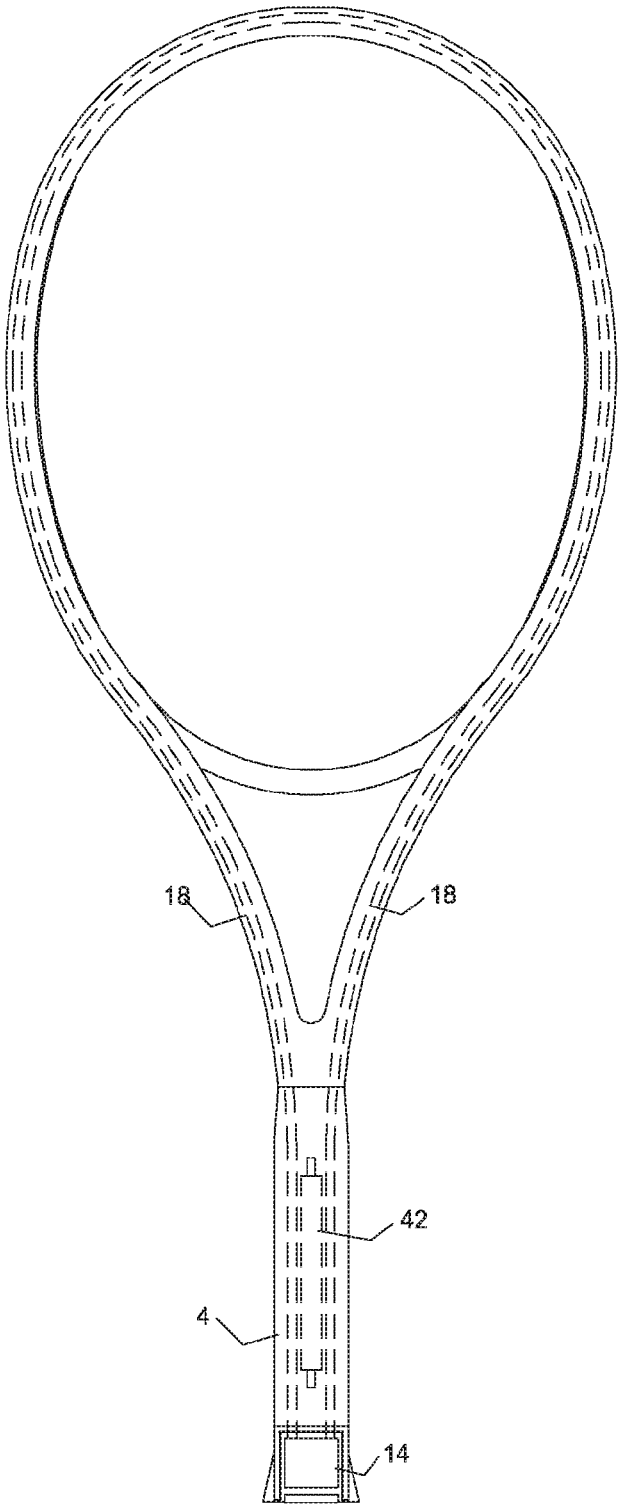
FIG. 12 depicts a schematic front elevation view of a game racquet.

FIG. 12 is a schematic front elevation view of the game racquet of the invention. It shows an arrangement of parts of an implementation of a system of the racquet 2.

Figure 13:
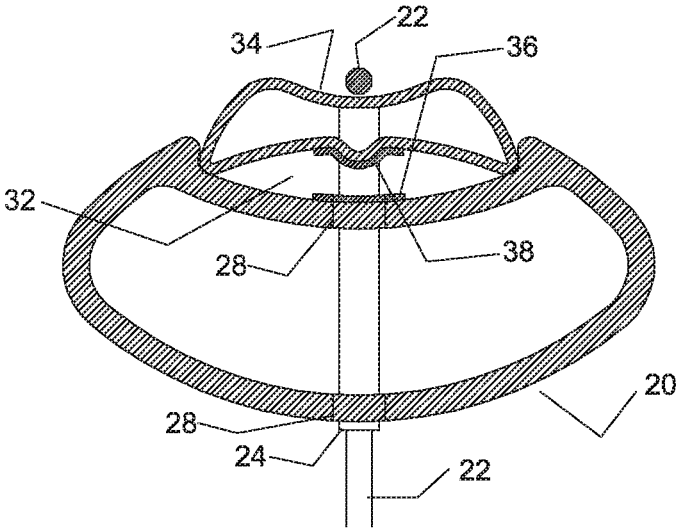
FIG. 13 depicts a cross-sectional view of the frame of a game racquet, along line 1-1 in FIG. 1.

FIG. 13 is a cross-sectional view, along line 1-1 in FIG. 1, of a head frame 10 or bridge member 8 of a game racquet 2 in accordance with an embodiment of the present invention. A string 22 is laced through a grommet 24 and grommet strip 26, through a string hole opening 28 in a frame profile 20, and through a hole opening 28 in a tubular actuator 34. The actuator 34 is located in a recess 32 on an outside facing surface 46 of a frame profile 20. The outer facing recess 32 is a common feature on modern racquets and is used for recessing and protecting a string 22 from exposure and damage. A grommet 24 and grommet strip 26 are employed here as injection molded parts made separately from the actuator 34 and are used in a typical manner to protect the string 22 from a potentially sharp edge in a hole opening 28.

Figure 14:
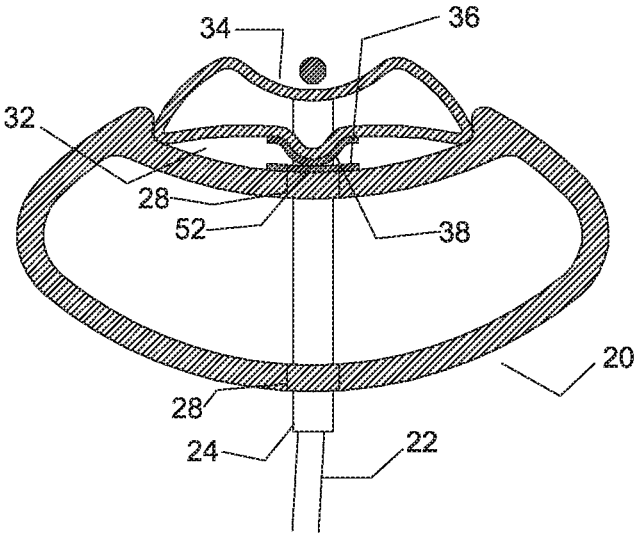
FIG. 14 depicts a cross-sectional view of the frame of a game racquet, along line 1-1 in FIG. 1, with the string movement under ball impact.

FIG. 14 is a cross-sectional view, along line 1-1 in FIG. 1, of a head frame 10 or bridge member 8 as tension of a string 22 has increased, for example due to a ball impacting a string-bed 12. Increased tension in the string 22 has compressed an actuator 34 inward to touch the exposed conducting surface 36 at the point of contact 52 in the bottom of the recess 32, therefore closing and activating the flow of current through the circuit 18. The flow of current in the circuit 18 therefore can be triggered by ball impact and can be employed to activate a sound amplification device 16, a light emitting device 40, a vibration emitting device 42, or another form of automation. The current flow generated by an actuator 34 could also be used in conjunction with a data collector for example, to record the number of successful hits, etc.

Figure 15:
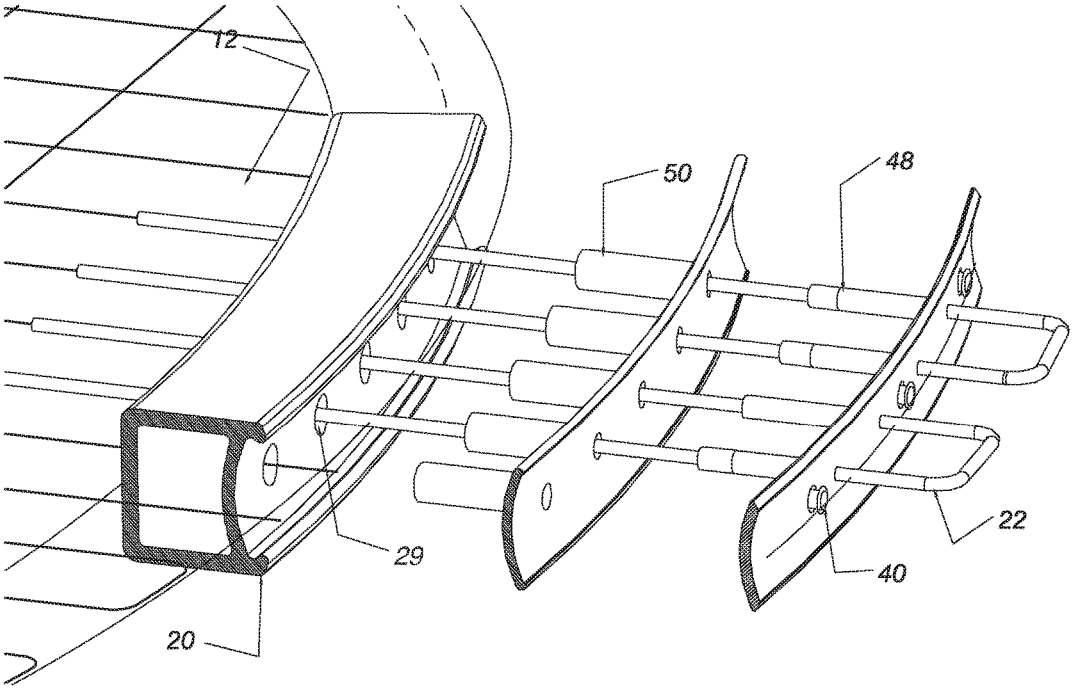
FIG. 15 depicts a three dimensional view of a portion of a head frame of a game racquet with segmental view of the actuator.

FIG. 15 is a 3-dimensional view of a portion of a head frame 10 of a game racquet 2 and its segmentation of the present invention. An actuator 34 is shown with a grommet 24 structured with an outer grommet 37 and an inner grommet 39 casing a string 22 in a string channel 29 in a segmented frame profile 20. For simplification, the grommet 24 structured with an outer grommet 37 and an inner grommet 39, and grommet strip 26 are eliminated in order to show the relationship of the working parts. The string-bed 12 is laced through the head frame 10 and through the actuator 34 inside the string channel 29. At the outside circumference of the string channel 29 of the frame profile 20 is the outer grommet 37 with an inward low-voltage conducting surface 36, which is continuous around the racquet head 10 and forms a portion of the circuit 18.

There are a number of options regarding the location and function of an actuator 34. An actuator 34 can cooperate with one or more string(s) 22 at a time. The particular application determines the specifics of the design. For example, the objectives for implementing an actuator 34 on a junior game racquet 2 may be different from the objectives for high performance competitive training.

For beginning juniors it may be beneficial to have a racquet 2 that responds to ball impact anywhere on the string-bed 12. No matter the skill level of a particular child, if they can just make contact with a ball on the strings, the racquet rewarding them may be considered a valuable training and reinforcement tool. In this case, an actuator 34 can be designed to cooperate with many strings at the same time and potentially one that is contiguous, at least, all around the head frame 10 such that contact with any one string 22 can trigger the actuator 34.

For advanced precision training, an actuator 34 can be implemented on a limited number of string(s) 22 in a string-bed 12. For example an actuator 34 or more than one actuator 34 could be designed to cooperate with only a small number of strings 22 which define the center of the string-bed 12. Only balls impacting a small area at the center of the string-bed 12 therefore, would register a response from the racquet 2, a great training apparatus for competitive high performance players. Additionally, an actuator 34 that works with one or two strings 22 individually could be employed in various ways to target specific areas of the string-bed 12 for response.

The actuator/grommet plate 34 can be utilized to achieve many different objectives. Its uses should not be limited only to those described herein; there will be others discovered by those skilled in the art. For example, the inside portion of the circuit 18 of the game racquet 2 of this invention could have one or more digital pressure sensors integrated along the outside inward conducting element 50 and the inside outward conducting element 48 which could be activated by one or more actuators in the same way that an actuator 34 can close a circuit 18. Pressure sensors arranged around the perimeter of the outer grommet for example, could be employed to collect data based on the dynamics of actual ball and string impact. By quantifying the pressure exerted by a string 22 on a profile 20, or in this case, on an actuator 34 cooperating with a string 22 exerting pressure on a sensor, valuable information can be gathered for training purposes or for measuring and gauging the relative performance of the racquet 2 itself.

Figure 16:
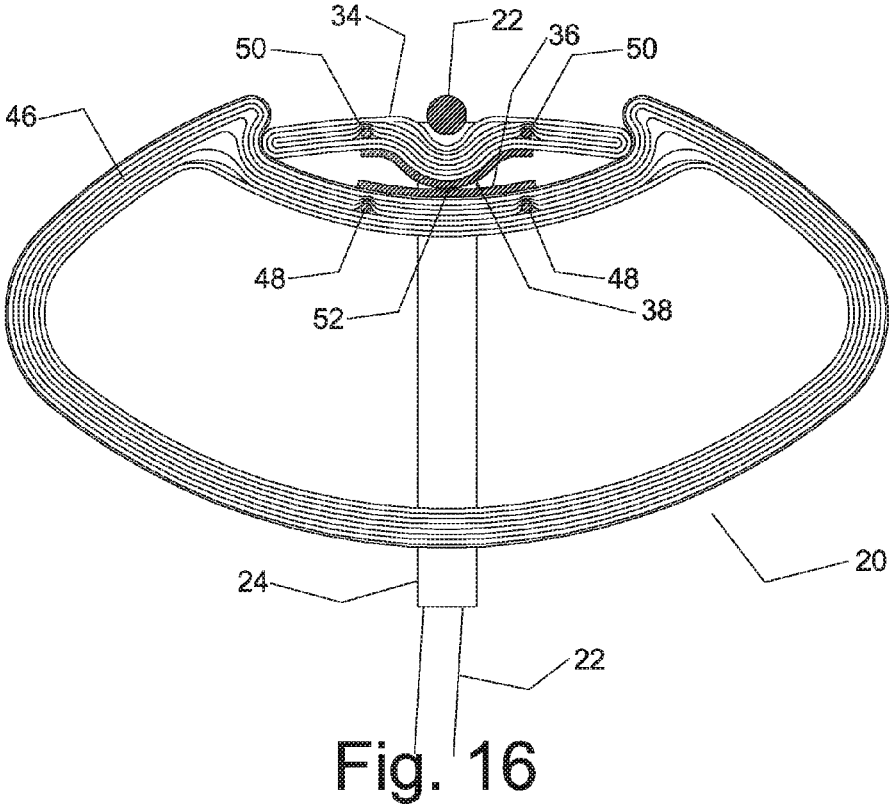
FIG. 16 depicts a cross-sectional view of the frame of a game racquet, along line 1-1 in FIG. 1.

FIG. 16 is a cross sectional detailed view, along line 1-1 in FIG. 1 of a frame profile 20 of a game racquet 2 in accordance with an embodiment of the present invention. This embodiment is made of rein impregnated composite material and fabricated using an inflation bladder molding technique, which is common in game racquet manufacturing. In short, this process involves the wrapping of multiple sheets of composite fabric 46 around an air bladder mounted on an anvil in the shape of a game racquet 2. The wrapped bladder is removed from the anvil and is placed in a mold cavity which defines the shape of a game racquet frame. The bladder is pressurized, expanding to fill the cavity, and sealed. The mold is then heated to cure the resin, thus solidifying the composite material to retain the shape of the cavity. This cross-sectional view shows an outside inward conducting element 50 "sandwiched" between multiple layers of composite fabric 46 which form the actuator 34. An inside outward conducting element 48 can be seen sandwiched between layers of composite fabric 46 in the frame profile 20 itself. This particular view depicts the actuator 34 depressed to touch the outside facing exposed conducting surface 36 at the point of contact 52 as if a ball is impacting a string 22.

Figure 17:
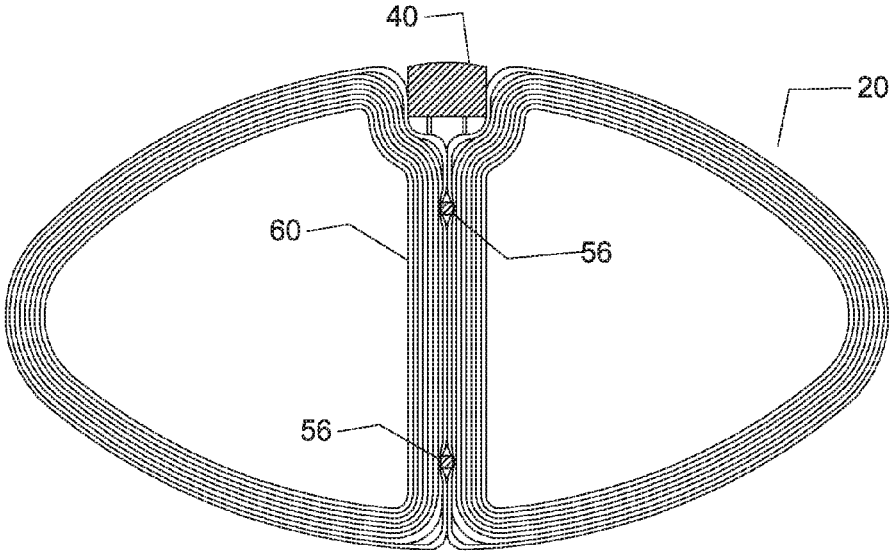
FIG. 17 depicts a cross-sectional view of a game racquet, along line 2-2 in FIG. 1.

FIG. 17 is a cross-sectional view, along line 2-2 in FIG. 1 of a frame profile 20 of a game racquet 2 of the present invention. The profile 20 comprises two tubular composite elements which are formed using two bladders side-by-side in a mold cavity in a variation of the inflation bladder molding method as described in the previous paragraph. The tubular composite elements are cured together having a common bonding wall 60 to form a unitary frame profile 20. The division between the composite elements provides a natural location for a conducting element 56 which can be sandwiched between the tubular elements prior to molding and then secured into place by curing/hardening the profile 20 during the molding process. The division between the composite elements also provides a natural location for a light emitting device 40. The light emitting device 40 can be located between the tubular elements prior to molding and is thus secured in place after the frame profile 20 is cured.

Figure 18:
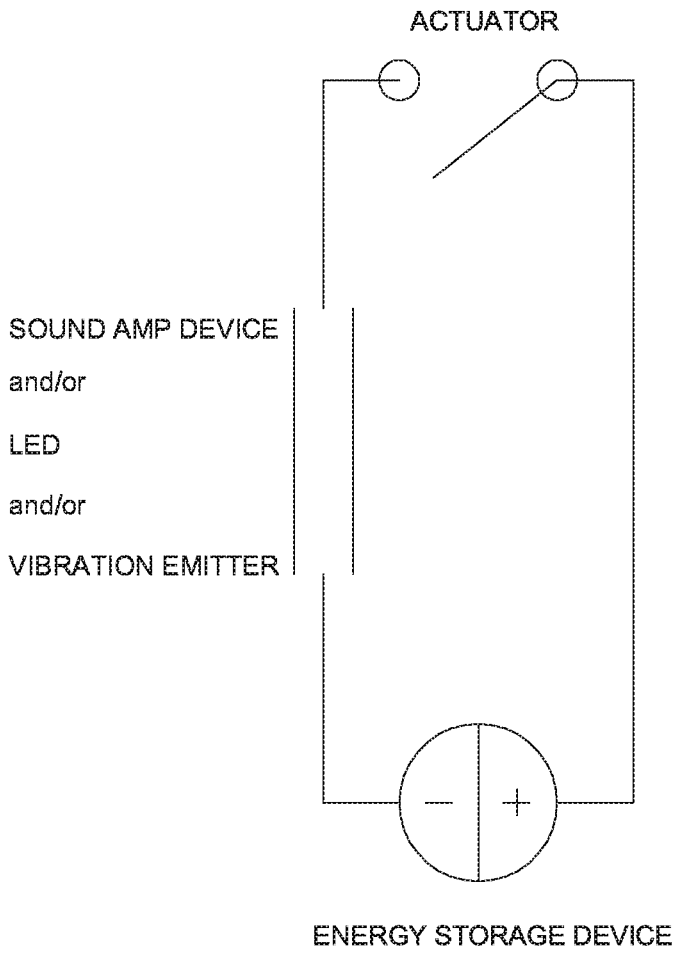
FIG. 18 depicts a schematic electrical diagram.

FIG. 18 is a schematic electrical diagram showing an arrangement of parts within an circuit 18 in the game racquet 2 of the present invention. An actuator 34 cooperating with a string 22 can be utilized as a switch to open and close the flow of current in a circuit 18. An actuator 34 cooperating with a string 22 can also be utilized to activate a pressure sensor as well.

Figure 19:
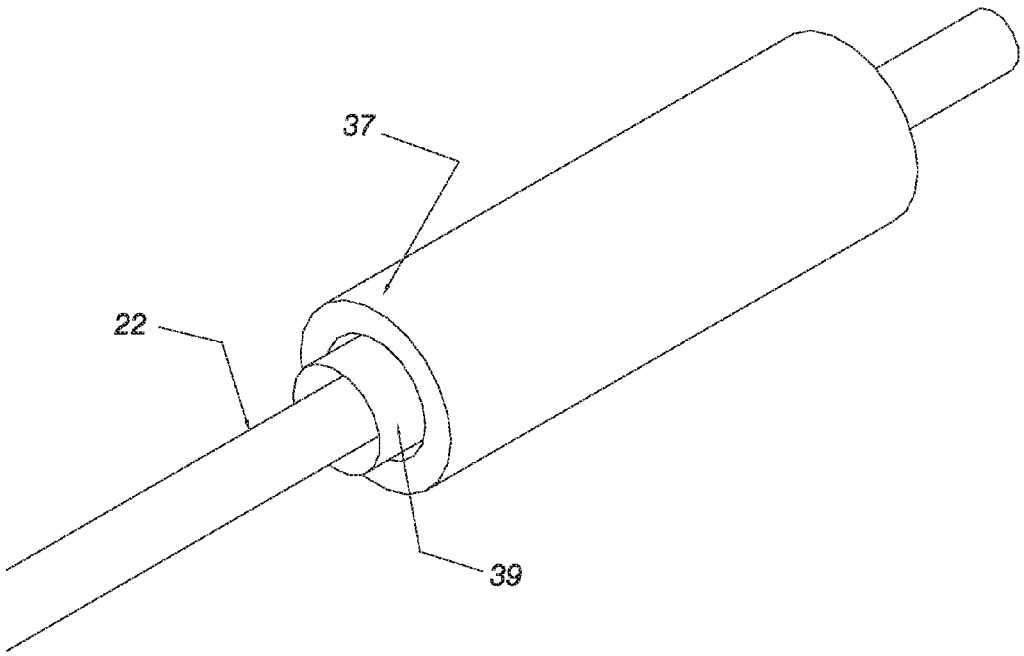

FIG. 19 is a cross-sectional view of an actuator 34 with a grommet 24 structured with an outer grommet 37 and an inner grommet 39 and a string 22 passing there through. The string 22 reacts directly with the physical force on the string-bed 12, which causing the oscillation of the string 22. The string movement triggers the casing inner grommet 39 to wobble inside the outer grommet 37, with the inner grommet's 39 outward conducting element 48 compressed on the inside circumference of the outer grommet 37—the inward conducting element 50. The compression of the outward conducting elements 48 and the inward conducting elements 50 located on the inner grommet 39 and the outer grommet 37 creates a closed circuit.

I claim:

1. A game racquet, comprising:

a circuit comprising an actuator that is configured to open or close the circuit in response to a string movement, the actuator further comprising an outer grommet with an inward conducting surface and an inner grommet with an outward conducting surface configured to form an electrical connection when the actuator is oscillated in response to the string movement;

a power source coupled to the circuit; and a game racquet frame coupled to the circuit and the power source, the game racquet frame comprising a handle, a throat, a bridge member, and a head frame;

the head frame comprising a plurality of string channel openings configured to pass a string there through; and wherein at least an opening among the plurality of string channel openings is further configured to house the actuator on a portion of an outside facing surface and through the string channel opening.

2. The game racquet of claim 1 wherein the actuator is tubular.

3. The game racquet of claim 1 wherein the actuator is comprised of a metal alloy.

4. The game racquet of claim 1 wherein the actuator is comprised of a resilient material.

5. The game racquet of claim 1 wherein the actuator is comprised of injection molded plastic.

6. The game racquet of claim 1 wherein the actuator is comprised of reinforced composite plastic.

7. The game racquet of claim 1 wherein the circuit extends through the bridge member.

8. The game racquet of claim 1 wherein the power source comprises at least one of a battery and a solar cell.

9. The game racquet of claim 1 wherein the frame further comprises a recessed channel on an outside facing surface housing at least a portion of one of the circuits and a portion of the plurality of actuators.

10. The game racquet of claim 1 wherein the circuit further comprises a plurality of lights configured to illuminate when the circuit is closed.

11. The game racquet of claim 1 wherein the circuit further comprises a vibration emitting device configured to vibrate when the circuit is closed.

12. The game racquet of claim 1 wherein the circuit further comprises a data collection device.

13. The game racquet of claim 1 wherein the circuit further comprises a sound amplification device.

14. A game racquet, comprising:

a circuit comprising an actuator that is configured to open or close the circuit in response to a string movement, the actuator further comprising an outer grommet with an inward conducting surface and an inner grommet with an outward conducting surface configured to form an electrical connection when the actuator is oscillated in response to the string movement; and a game racquet frame coupled to the circuit, the game racquet frame comprising a handle, a throat, a bridge member, and a head frame;

the head frame comprising a plurality of string channel openings configured to pass a string there through; and wherein at least an opening among the plurality of string channel openings is further configured to house the actuator on a portion of an outside facing surface and through the string channel opening.

15. The game racquet of claim 14 wherein the circuit further comprises a power source; and the power source comprises at least one of a battery and a solar cell.

16. The game racquet of claim 14 wherein the circuit further comprises a plurality of lights configured to illuminate when the circuit is closed.

17. The game racquet of claim 14 wherein the circuit further comprises a data collection device.

18. The game racquet of claim 14 wherein the circuit further comprises a sound amplification device.

* * * * *